US007694437B2

(12) United States Patent
Hogan

(10) Patent No.: US 7,694,437 B2
(45) Date of Patent: Apr. 13, 2010

(54) SUSPENDED ORTHOTIC SHOE AND METHODS OF MAKING SAME

(75) Inventor: Patrick J. Hogan, Bothell, WA (US)

(73) Assignee: PSB Shoe Group, LLC, Mill Creek, WA (US)

( * ) Notice: Subject to any disclaimer, the term of this patent is extended or adjusted under 35 U.S.C. 154(b) by 777 days.

(21) Appl. No.: 11/167,916

(22) Filed: Jun. 27, 2005

(65) Prior Publication Data

US 2006/0288611 A1 Dec. 28, 2006

(51) Int. Cl.

| | |
|---|---|
| ***A43B 13/14*** | (2006.01) |
| ***A43B 7/14*** | (2006.01) |
| ***A43B 7/22*** | (2006.01) |
| ***A43B 7/32*** | (2006.01) |
| ***A43B 136/16*** | (2006.01) |

(52) U.S. Cl. ..... 36/25 R; 36/114; 36/102; 36/107; 36/88

(58) Field of Classification Search ..... 36/25 R, 36/103, 31, 145, 150, 30 R, 102, 114, 107, 36/88, 140, 154

See application file for complete search history.

(56) References Cited

U.S. PATENT DOCUMENTS

| | | | | |
|---|---|---|---|---|
| 5,317,819 | A * | 6/1994 | Ellis, III | 36/25 R |
| 5,367,791 | A | 11/1994 | Gross et al. | |
| 5,840,053 | A * | 11/1998 | Roth | 602/66 |
| 6,119,373 | A * | 9/2000 | Gebhard et al. | 36/114 |
| 6,226,896 | B1 * | 5/2001 | Friton | 36/28 |
| 6,237,251 | B1 | 5/2001 | Litchfield et al. | |
| 6,338,768 | B1 * | 1/2002 | Chi | 156/269 |
| 6,438,873 | B1 * | 8/2002 | Gebhard et al. | 36/114 |
| 6,954,998 | B1 | 10/2005 | Lussier | |
| 2002/0092201 | A1 * | 7/2002 | Kraeuter et al. | 36/25 R |
| 2004/0226192 | A1 | 11/2004 | Geer et al. | |
| 2005/0115109 | A1 | 6/2005 | Goldman | |

FOREIGN PATENT DOCUMENTS

| | | | |
|---|---|---|---|
| EP | 1114591 | A2 | 11/2001 |
| EP | 1308103 | A2 | 5/2003 |

* cited by examiner

*Primary Examiner*—Jila M Mohandesi
(74) *Attorney, Agent, or Firm*—Black Lowe & Graham, PLLC

(57) ABSTRACT

A shoe provides a suspended orthotic system that includes at least a contoured, three-dimensional chassis configured with a heel cup. The chassis provides the primary support and determines the shape and form of the shoe. The chassis receives a footbed, which includes a first material integrally formed with a second material, both materials operating to provide an orthotic benefit. A shoe sole includes a number of pods that are selectively arranged and coupled to the chassis to actively suspend the chassis and the footbed. The shoe can further include a dynamic arch support system that manually or automatically adjusts the arch region of the shoe. The shoe may be more comfortable, provide biomechanical advantages, be lighter, and be more stylish than traditional shoes.

16 Claims, 12 Drawing Sheets

SUSPENDED ORTHOTIC SHOE AND METHODS OF MAKING SAME

BACKGROUND OF THE INVENTION

1. Field of the Invention

This disclosure generally relates to a shoe having an integrated orthotic footbed that is suspended to enhance the comfort and biomechanical aspects of the shoe.

2. Description of the Related Art

Footwear designers have always been faced with conflicting design choices, for example comfort versus appearance or style. This design choice is especially critical in the sport, casual, dress and casual dress shoe markets because consumers want stylish shoes that are comfortable all day long. In addition to the challenge of trying to balance comfort with style, shoe designers must account for the vast array of foot sizes and shapes. Some people have wide feet and high arches, while others may have narrow feet and high arches, for example.

Shoes are comprised of several basic components, which are an upper, a lasting board and/or insole, and an outsole (i.e., sole). The upper includes all parts of the shoe, above the sole that are attached to the lasting board and the sole. The lasting board is a two-dimensional layer of material that separates the upper from the sole. The sole is the outermost or bottommost part of the shoe that is exposed to abrasion and wear. The sole is typically made from a synthetic polymer such as rubber and can have a varying thickness and sole pattern or tread.

In the construction of the shoe, most shoes are formed around a last, which is a removable, three-dimensional block with dimensions and shape similar to an anatomical foot. The last is not the same size and dimensions of the anatomical foot, but instead is a statistically determined model with specific functions. The last was traditionally carved from wood, but current technology permits the last to be machined from plastic or metal with computer numerical control (CNC) machines. Regardless of what material is used to make the last, the bottom of the last must be flat in order construct the shoe according to conventional shoe construction techniques. The last is typically hinged around the instep so that it can be removed from the shoe after the upper and lower are formed.

After the last has been formed, the two-dimensional lasting board is formed and shaped in accordance with the flat, bottom portion of the last. The lasting board is a component of the shoe, unlike the removable last described above. Either a stitching or a molding process, which may include a strip of material called a welt, attaches the upper to the lasting board. The sole is typically cemented to the lasting board. Additionally, a shank and/or a heelpiece can be included in the shoe. The shank extends between the heel and the ball portions of the shoe and operates to reinforce the waist of the shoe to prevent collapse of and/or distortion of the shoe in use.

Shoe construction, even when using common manufacturing equipment and techniques, still tends to be a labor intensive and a subjective process. Traditionally, shoes are either comfortable or stylish, but not both. Forming the lasting board from the flat, bottom portion of the last may result in poor fitting and/or uncomfortable shoes.

Poor fitting and/or uncomfortable shoes can cause a variety of biomechanical problems with respect to the wearer's anatomical feet, knees, legs, hips, and even back. Planter fasciitis is one common problem that is either caused or exacerbated by poor fitting shoes and/or insufficient cushioning and support. One approach to alleviating or even eliminating biomechanical problems associated with poor fitting shoes is to use customized orthotic devices, which are typically fashioned by a podiatrist. However, custom orthotic devices are expensive and may only fit in certain styles of shoes.

With so many variables involved in the design, assembly and manufacture of shoes, there continues to be a need for a comfortable, stylish, and a more biomechanically friendly shoe.

SUMMARY OF THE INVENTION

A shoe, as described herein, includes a three-dimensional, molded orthotic chassis with a heel cup. The orthotic chassis operates as a lasting board. The orthotic chassis receives an orthotic footbed, which includes a first material integrally formed with a second material, both materials operating to provide an orthotic benefit to the wearer of the shoe. A shoe sole, which includes a number of pods, is selectively arranged and coupled to the orthotic chassis to actively suspend the orthotic chassis and the associated orthotic footbed on the pods. The shoe can further include an adjustable arch support system. The shoe may be more comfortable, may provide biomechanical advantages, may be lighter, and may be more stylish than traditional shoes.

In another aspect, a shoe includes an orthotic chassis having an upper surface; an orthotic footbed having a first surface contoured to complementarily conform and be nested in contact with the upper surface of the orthotic chassis; and a shoe sole comprising a plurality of pods, each pod coupled to the orthotic chassis in a selective arrangement, wherein a first region of the orthotic chassis spans a distance between respective pods.

In yet another aspect, a shoe includes an orthotic chassis having an upper surface and configured with a three-dimensional contour; an orthotic footbed having a first surface contoured to complementarily conform and be nested in contact with the upper surface of the orthotic chassis; and a shoe sole coupled to the orthotic chassis.

In yet another embodiment, a shoe includes an orthotic chassis having a heel region, an arch region, and a forward region; an orthotic footbed having a first surface contoured to complementarily conform and be nested in contact with the upper surface of the orthotic chassis; a shoe sole coupled to the orthotic chassis; and a dynamic arch system configured to adjust the arch region of the orthotic chassis.

In still yet another embodiment, a shoe sole for attaching to an orthotic chassis of a shoe, the orthotic chassis configured with a three-dimensional profile to provide orthotic benefits, the shoe sole includes a first pod coupled to the orthotic chassis; a second pod coupled to the orthotic chassis and spaced apart a first distance from the first pod, wherein a first region of the orthotic chassis spans the first distance between the first pod and the second pod, wherein the first distance is determined such that the first region of the orthotic chassis operates to actively adjust to an amount of applied force, which acts like a suspension system.

In yet another aspect, a method of making a shoe includes obtaining an orthotic chassis having a three-dimensional upper surface; supporting an orthotic footbed on the orthotic chassis, the orthotic footbed having a first surface contoured to complementarily conform and be in close contact with the upper surface of the orthotic chassis; coupling a plurality of pods to the orthotic chassis in a selective arrangement, wherein each pod is spaced apart by a distance from another pod such that a region of the orthotic chassis spans the spaced apart distance between the respective pods; and attaching a shoe upper to the shoe.

In a final aspect, a shoe includes support means for resiliently supporting an amount of force, the support means configured with a three-dimensional contour; orthotic means for providing an orthotic benefit to a wearer of the shoe, the orthotic means having a first surface contoured to complementarily conform and be in close contact with the upper surface of the support means; and contact means for operating in cooperation with the support means supports the amount of force.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with shoes and the assembly thereof have not necessarily been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

In addition, throughout the specification and claims which follow, the word "shoe" is meant as a broad term that includes a variety of footwear, such as sport, casual, dress and casual dress shoes. The word "shoe" can include boots of all types, for example ski boots, hiking boots, and/or climbing boots. Thus, the word "shoe" should be construed in a general and a broad sense to include a wide variety of footwear. The term "orthotic" is used to generally indicate that certain shoe components may impart an orthotic benefit and/or serve an orthotic function. Providing an orthotic benefit or serving an orthotic function generally means that the shoe component is generally supportive, assists in aligning the foot and/or body, assists in balancing the weight of the body, assists in relieving stress in the joints and muscles, and/or functions to reduce or even prevent discomfort or pain in various parts of the body.

The headings provided herein are for convenience only and do not interpret the scope or meaning of the claimed invention.

The following description relates generally to a shoe that is constructed and arranged to produce a more comfortable and aesthetically pleasing shoe. The comfort of the shoe is derived, in part, by suspending an orthotic chassis on a number of independent suspension pods. The orthotic chassis is three-dimensional and supports a self-adjusting, orthotic footbed that is complimentarily contoured according to the three-dimensional shape of the orthotic chassis. Overall, the shoe, as described herein, may provide additional comfort and biomechanical benefits, have a sleeker profile and a lighter weight design, and may be more aesthetically pleasing compared to many other types of shoes presently on the market.

Suspended Orthotic Shoe

Figure 1:
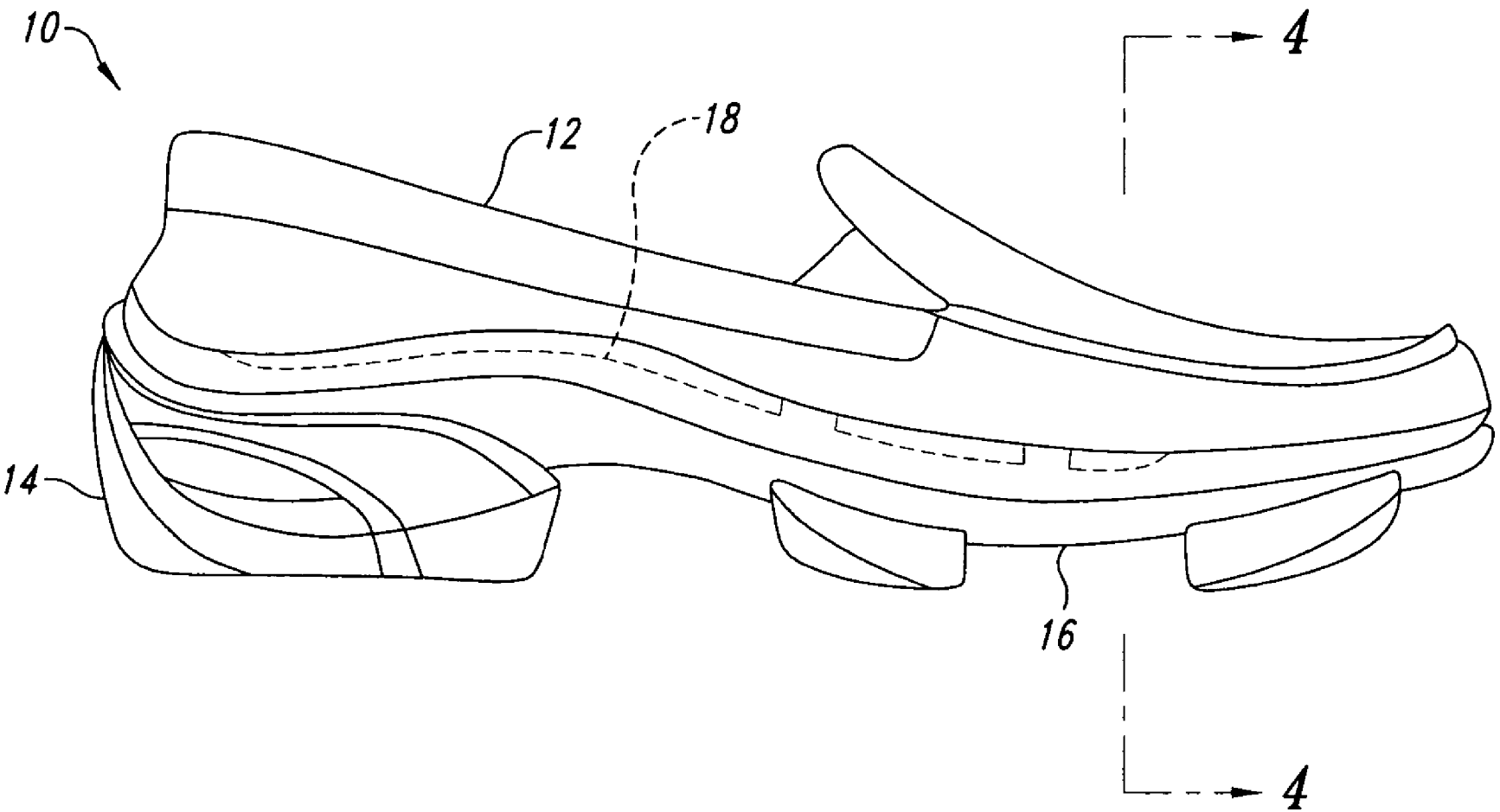
FIG. 1 is a side elevational view of a shoe provided in accordance with one illustrated embodiment.

FIG. 1 shows a shoe 10 having an upper 12, a sole 14, an orthotic chassis 16, and an orthotic footbed 18. The shoe 10 is designed to be comfortable and of lightweight construction. The upper 12 can take a variety of shapes, styles, and designs, for example the upper 12 can take the form of a sport, casual, dress and/or casual dress (e.g., a loafer or a sandal) according to the illustrated embodiment. The shape, design, and/or the overall "look" of the upper 12 can be widely varied and/or modified depending on the purpose of the shoe. The various methods of attaching the upper 12 to form the shoe 10 are known in the art, so in the interest of brevity, the upper 12 and methods of attaching the upper to the shoe 10 will not be described in any further detail.

Figure 2:
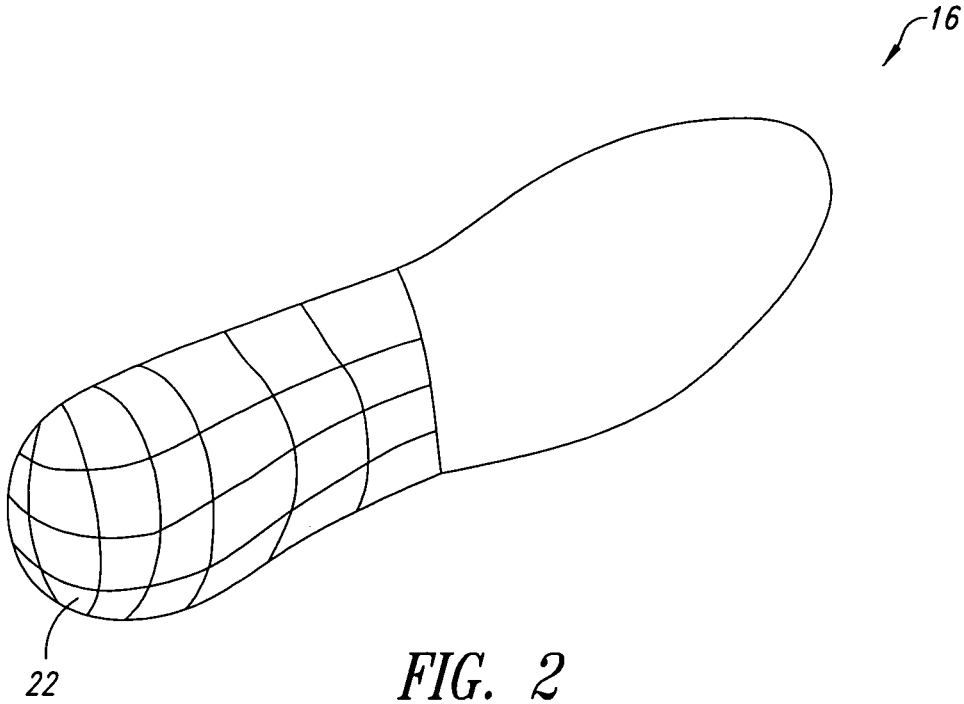
FIG. 2 is a bottom, right isometric view of an orthotic chassis formed with a heel cup according to one illustrated embodiment.
Figure 3:
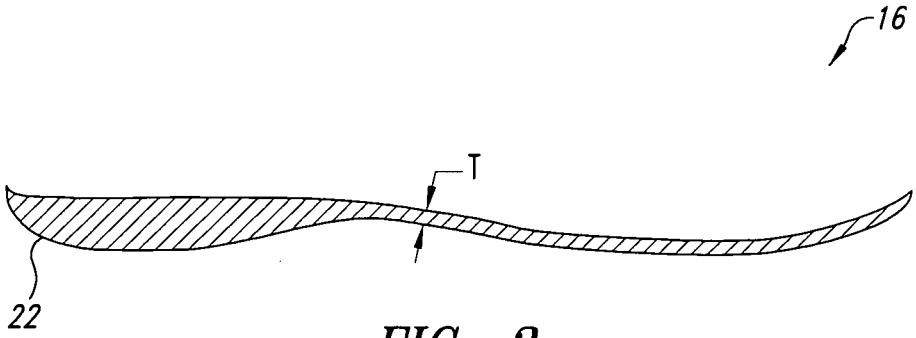
FIG. 3 is a cross-sectional view of the orthotic chassis of FIG. 2.

FIGS. 2 and 3 show the orthotic chassis 16, which is formed with an anatomical, three-dimensional contour, made from a resilient material, and which includes an integrated heel cup 22, according to the illustrated embodiment. The orthotic chassis 16 operates as an anatomical, three-dimensional, contoured, molded lasting board because it provides the primary support for the shoe 10. The anatomical, three-dimensional contour combined with the resilient material allows the orthotic chassis 16 to more comfortably accommodate the anatomical foot shape. The integrated heel cup 22 provides at least some amount of lateral support and/or lateral compression for the heel of the foot. Unlike shoes that are built up from a two-dimensional shoe last, the heel cup 22 acts to maintain the heel in more of a cup-shaped form instead of allowing the heel to flatten out when weighted. Maintaining the heel in more of a cup-shaped form can make the shoe 10 more comfortable and provide biomechanical benefits to the wearer.

The orthotic chassis 16 may be made from any variety of materials, for example a pre-formed fiberboard, a molded plastic compound, or vacuum formed thermal plastic urethane (TPU) according to one embodiment. TPU can be obtained in a variety of different densities. In addition, the orthotic chassis 16 can be molded into a variety of shapes and contours as determined by a shoe designer. Further, the orthotic chassis 16 can have a varying thickness "T". It is understood and appreciated that other materials that serve the same purpose and function can be substituted for TPU to make the orthotic chassis 16. In embodiment, the orthotic chassis 16 includes a design inlay that may be color matched to the color of the upper. In addition, logos and/or other features can be baked into the orthotic chassis 16 to enhance the market appeal of the shoe 10.

Figure 4:
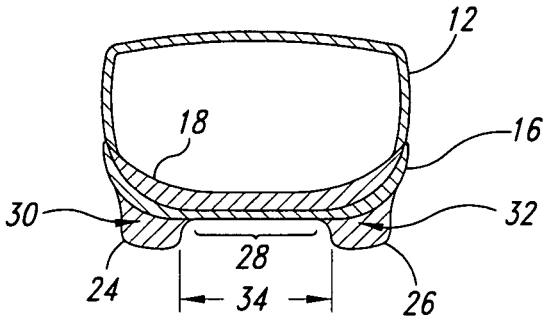
FIG. 4 is a cross-sectional view of the shoe of FIG. 1 showing the orthotic chassis supported and spanning a distance between two front pods of the sole.

FIG. 4 shows a cross section of the shoe 10 supported on a set of front pods 24, 26 and the second front pod 26 of the sole 14 according to the illustrated embodiment. By way of example, the interaction between the front pods 24, 26 of the sole 14 and the orthotic chassis 16 will be described in greater detail. However, it should be understood that the present discussion can apply to any two sets of pods attached to the orthotic chassis 16, regardless of whether the pods are located in the front region, arch region, or heel region of the shoe 10.

The orthotic chassis 16 includes a first region 28 connected by a first end section 30 and an opposing second end section 32. The first front pod 24 is separated from the second front pod 26 by a span distance 34, which is the maximum distance between the respective front pods 24, 26 such that the first region 28 of the orthotic chassis 16 is able to bear a determined amount of force without an excessive amount of deflection. An excessive amount of deflection, in one instance, is when at least a portion of the first region 28 deflects low enough to make contact with the ground or other surface. The first region 28 spans the span distance 34 in an unsupported manner and is thus suspended between the respective front pods 24, 26. The front pods 24, 26 are placed in key strike places of the shoe 10.

This unique concept of suspending the orthotic chassis 16 between the front pods 24, 26 advantageously increases the ability of the orthotic chassis 16 to actively conform and adjust to both dynamic and static forces (e.g., the weight of the wearer) applied to the orthotic chassis 16. The first region 28 beams or transfers the applied force to the respective front pods 24, 26. Thus, the first region 28 operates as a beam having either a linear or a non-linear spring stiffness. In general, it is understood that the spring stiffness will be non-linear because the orthotic chassis 16 is generally fixed to the front pods 24, 26. In addition, the spring stiffness is adjustable and can be modified by adjusting any of a number of design parameters such as the distance 34 between the front pods 24, 26, the height of the front pods 24, 26, the method of attaching the front pods 24, 26 to the orthotic chassis 16, the thickness and/or materials used to make the orthotic chassis 16 and/or orthotic footbed 18 (described in more detail below), as well as other parameters that one of skill in the art will appreciate and understand.

Figure 5:
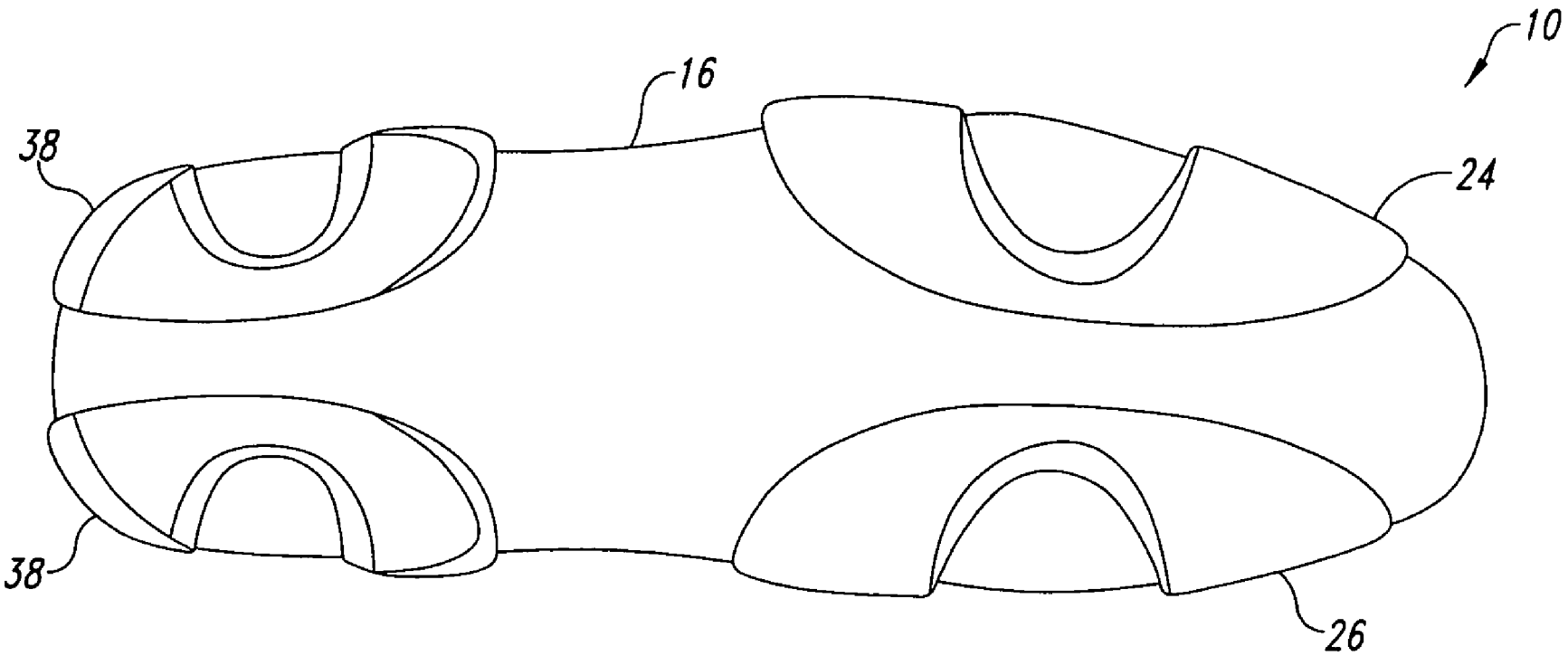
FIG. 5 is a bottom view of the shoe of FIG. 1 where a sole is comprised of a plurality of pods selectively arranged and adhered to an orthotic chassis according to the illustrated embodiment.

FIG. 5 shows the sole 14 having the set of front pod 24, 26 and a set of heel pods 38 selectively coupled to suspend the orthotic chassis 16 according to the illustrated embodiment. Selectively arranging the pods of the sole 14 enhances the flexibility of the shoe 10 and reduces the weight of the shoe 10 in comparison to a conventional shoe sole of similar material that is a one-piece slab of rubber or synthetic polymer bonded to the planar lasting board.

The sole 14 of the shoe 10 is generally manufactured to meet certain performance characteristics such as durometer, tensile strength, elongation percentage, tear strength, and abrasion index. The ranges of these performance characteristics can vary depending on the type of shoe 10 onto which the sole 14 will be attached. Some shoes require greater abrasion resistance, while others require more cushioning, etc. In addition, there may be trade-offs or competing performance characteristics. For example, a lower abrasion resistance may be necessary to achieve a softer feel or better grip. It is understood and appreciated that the pods of the sole 14 can be made according to a number of performance characteristics, which may be specified by an end user, retailer, and/or manufacturer.

In one embodiment, the selective arrangement of the front pods 24, 26 is determined by generating a statistical average of the strike or high wear locations of the shoe sole 14. For example, because the majority of people pronate, instead of supinate, one embodiment of the shoe 10 can have fewer and/or thinner pods on the outer, front portion of the shoe 10. Accordingly, the selective arrangement of the pods comprising the sole 14 produces a lightweight, yet durable shoe.

Figure 6:
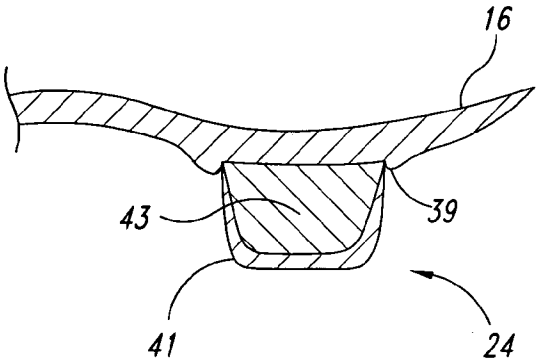
FIG. 6 is a cross-sectional view of the front portion of the orthotic chassis of FIG. 3 with integrally formed protuberances.

FIG. 6 shows an alternate embodiment of the orthotic chassis 16 having dams 39 that are integrally molded with the orthotic chassis 16 and at least slightly protrude from the bottom surface of the orthotic chassis 16. The dam includes a recessed region to receive the pod 24 and a lip that extends down and slightly over the pod 24. As best seen in FIG. 6, the front pod 24 is exemplarily shown bonded and slightly recessed into the dam 39. The dam 39 provides a defined, stable bonding surface for the pods of the sole 14.

In one embodiment, the sole 14 comprises a hard rubber casing 41 surrounding a softer, rubber core 43, such as polyurethane, ethyl vinyl acetate (EVA), or even EPQ (i.e., a dual density pod). In another embodiment, the sole 14 is made from VIBRAM® brand rubber material.

The pod 24, when bonded to the above-described dam 39 may advantageously prolong the life of the pod 24 by not allowing moisture to infiltrate and eventually degrade the softer core material 43 of the pod 24. Thus, water traveling along the bottom surface of the orthotic chassis 16 will flow down the dam 39, and then down the pod 24 and thereby substantially keep the moisture away from the bonding region between the chassis 16 and the dam 39.

Figure 7:
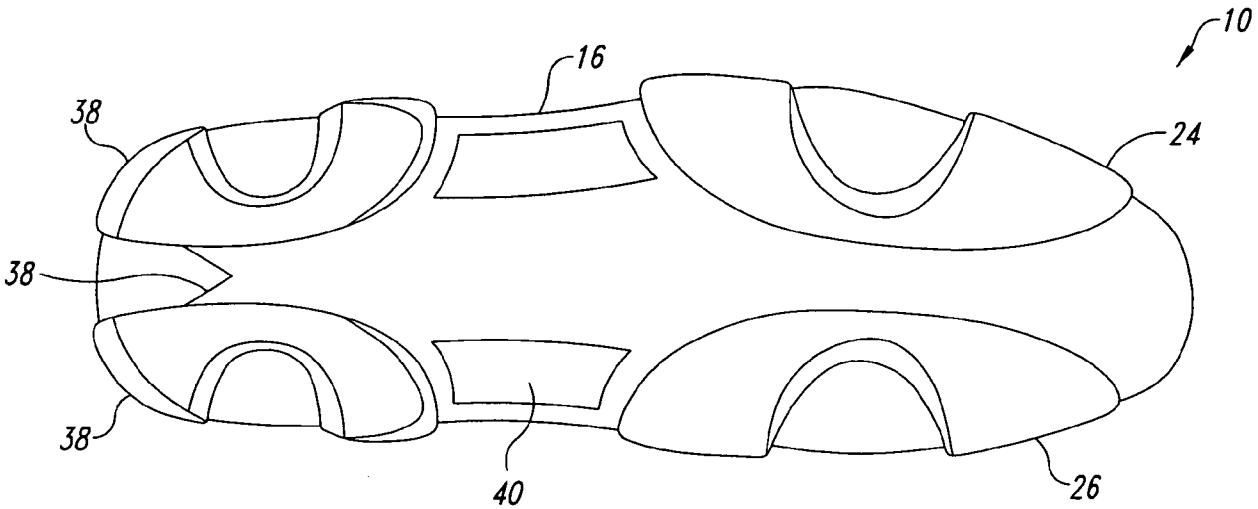
FIG. 7 is a bottom plan view of a shoe where a sole is comprised of pods selectively arranged and adhered to only a heel portion and a front portion of an orthotic chassis and where the heel pods are connected with a torsional restraint according to one illustrated embodiment.

FIG. 7 shows an alternate embodiment of the sole 14 having colored plates 40 bearing the size, logo and/or brand of the shoe 10. The colored plates 40 are bonded to the underneath, arch region of the orthotic chassis 16 and replace the arch pods 36 described above. Although not required, in one embodiment a torsional restraint 42 is provided between the heel pods 38. The torsional restraint 42 operates to biasly maintain a desired amount of space between the heel pods 38 and provide the heel pods 38 with additional lateral support, which can keep the heel pods 38 from rolling under or shearing when subjected to a lateral force. For example, the restraint 42 keeps the heel pods 38 from separating too much or being forced too close together.

Figure 8:
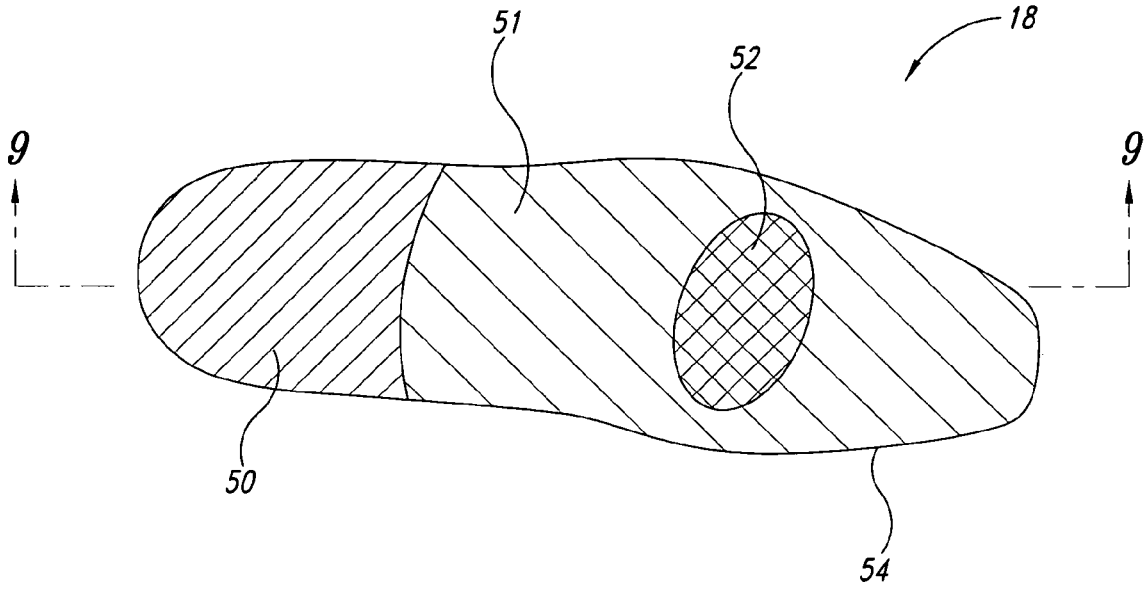
FIG. 8 is a top plan view of an orthotic footbed according to one illustrated embodiment.
Figure 9:
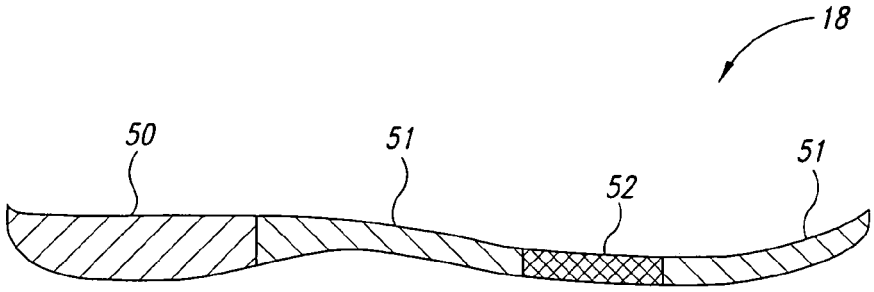
FIG. 9 is a cross-sectional view of the orthotic footbed of FIG. 8.

FIGS. 8 and 9 show the orthotic footbed 18 is formed from two or more different materials, the same material that can be configured to have two or more different density regions (e.g., the amount of firmness of the material from one region to the next), or some combination thereof, according to the illustrated embodiment. It is understood and appreciated that the orthotic footbed 18 operates as an orthotic support member for the anatomical foot and that the different regions of the footbed 18 are configured to provide different levels of support and/or firmness for the anatomical foot.

In the illustrated and exemplary embodiment, the orthotic footbed 18 is made from a triple density EPQ material. EPQ has a jelly-like characteristic with good resilience and restorability while being formable in different densities. Referring to FIG. 8, the exemplary embodiment shows that the orthotic footbed 18 includes a heel region 50 formed from a firm density EPQ material, a second region 51, which is forward of the heel region 50, formed from a medium-firm density EPQ material, and a metatarsal region 52 formed from a soft density EPQ material. Alternatively, the regions 50, 51, and 52 may be comprised of three different materials, for example the heel region 50 can be a firm density TPU material, the second region 51 can be a medium-firm density EPQ material, and the metatarsal region 52 can be a soft density EPV material. It is understood and appreciated that the firmness and/or softness of the various materials (i.e., the respective density of the material) can vary from shoe to shoe. Although the heel region 50 is described as being firmer than the other regions 51, 52 in the exemplary embodiment above, there is no requirement that this be the case. It is further understood that each of the regions 50, 51, 52 can have different levels of firmness relative to one another and/or that the footbed 18 may comprise more or fewer regions than shown in the exemplary embodiment.

The heel region 50 operates to stabilize and cup the heel, the second region 51 operates to support the arch region of the anatomical foot, and the metatarsal region 52 operates to support the plantar fascia region of the anatomical foot. Depending on the firmness of the various regions 50, 51, and/or 52, the footbed 18 can operate with the chassis 16 to distribute body weight to the pods of the sole 14. In addition, the configuration of the footbed 18 can help control foot elongation, since the foot tends to elongate when weighted. The footbed 18 may reduce or counteract the amount of pronation and/or supination of the wearer by distributing the weight of the wearer in a desired manner. Additionally or alternatively, the footbed 18 can help to stabilize portions of the anatomical foot and/or provide added support such as cushioning support for the plantar fascia ligament. It is understood, that the configuration of the orthotic footbed 18 can be customized to specifically address a number of biomechanical issues, of which plantar fasciitis is just one such issue, and provide a variety of orthotic benefits to the wearer.

Figure 10:
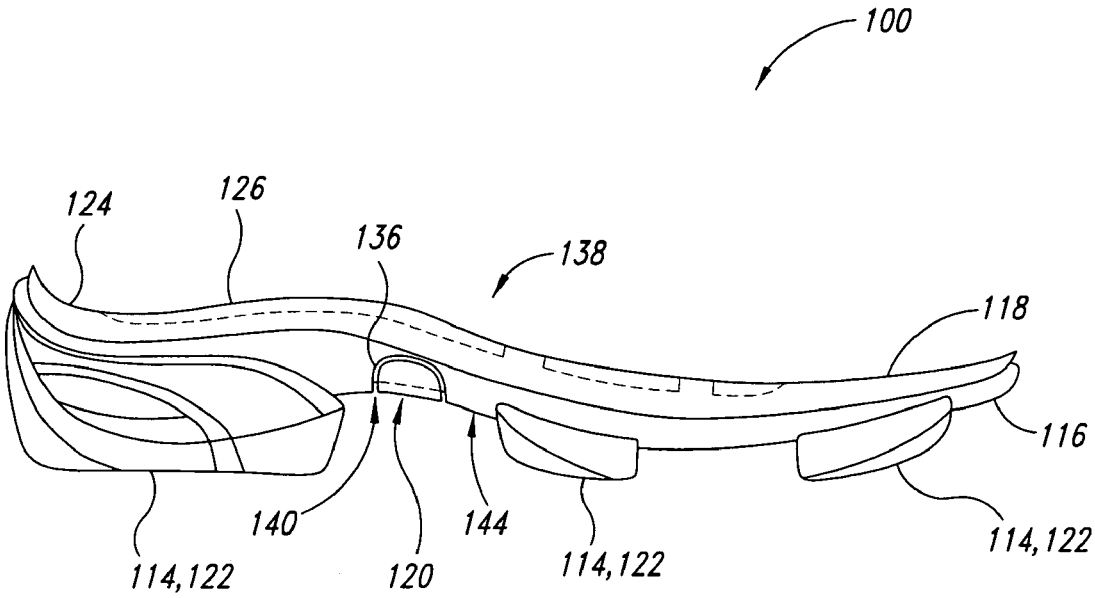
FIG. 10 is a side, elevational view of a shoe having a dynamic arch system according to one illustrated embodiment.
Figure 11:
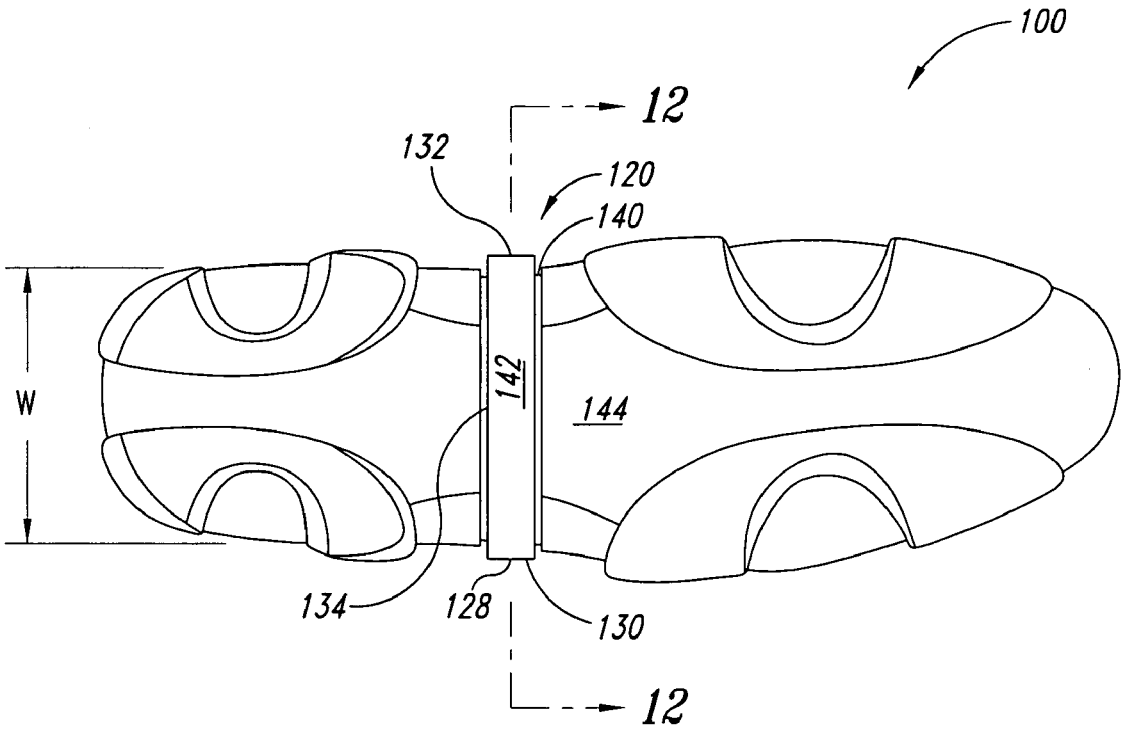
FIG. 11 is a bottom plan view of the shoe of FIG. 10.
Figure 12:
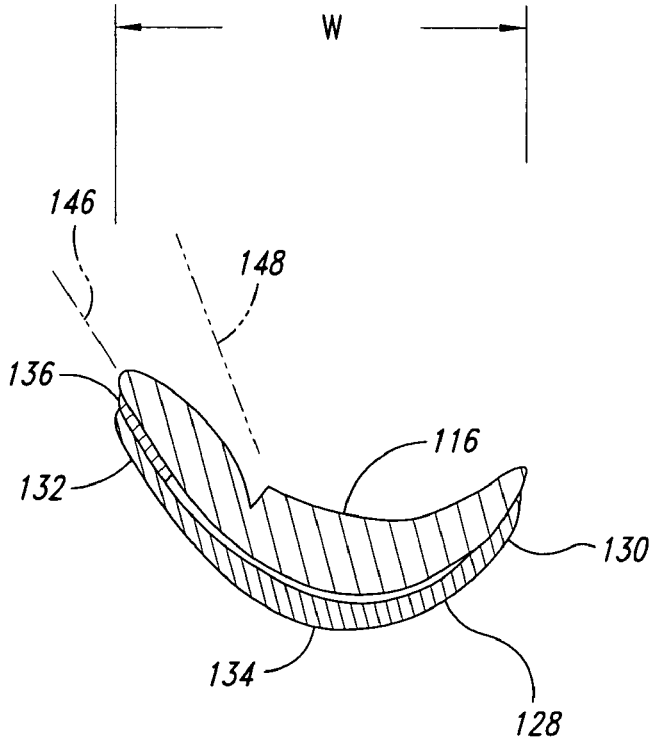
FIG. 12 is a cross-sectional view through the arch region of the shoe of FIG. 10.

FIGS. 10 through 12 show several components of a shoe 100 including a sole 114, an orthotic chassis 116, an orthotic footbed 118, and a dynamic arch system 120 according to another illustrated embodiment. The sole 114 is again comprised of a plurality of pods 122 selectively arranged and coupled to the orthotic chassis 116. The orthotic footbed is integrally formed from a first material 124 and a second material 126 as described above.

The dynamic arch system 120 comprises a strap 128 having a first portion 130, an engagement portion 132, and an intermediate portion 134, and a receiving member 136 to engage the engagement portion 132 of the strap 128 according to the illustrated embodiment. The first portion 130 is coupled to one side of the arch region 138 of the orthotic chassis 116. The intermediate portion 134 extends from the first portion 132 underneath and across the arch region 138. In one embodiment, a channel 140 is formed in the arch region of the orthotic chassis 116 to receive the strap. The channel 140 permits the exposed surface 142 of the strap 128 to be flush with the surface 144 of the orthotic chassis 316 that is adjacent to the channel 140.

The engagement portion 132 of the strap is adjustably attachable to and configured to engage the receiving member 136. The receiving member 136 is coupled to the orthotic chassis 116. In one embodiment, the receiving member is one portion of a VELCRO® brand fastening system having either a plurality of hooks or loops. Likewise, the engagement portion 132 comprises a complimentary portion of the VELCRO® brand fastening system. The receiving member 136 is bonded or otherwise secured to a portion of the orthotic chassis 116.

FIG. 12 shows that the strap 128 of the dynamic arch system 120 is adjustable to a first position 146 to laterally increase a width "W" of the arch region 138 of the orthotic chassis 116. Similarly, the strap 128 is adjustable to a second position 148 to laterally reduce the width "W" of the arch region 138 of the orthotic chassis 116. In addition, the orthotic chassis 116 can include a notch 150 in the arch region 138 to give the orthotic chassis 116 a bit more flexibility. Additionally or alternatively, the orthotic chassis 116 can be formed with a reduced thickness in the arch region 138 to also achieve additional flexibility.

Figure 13:
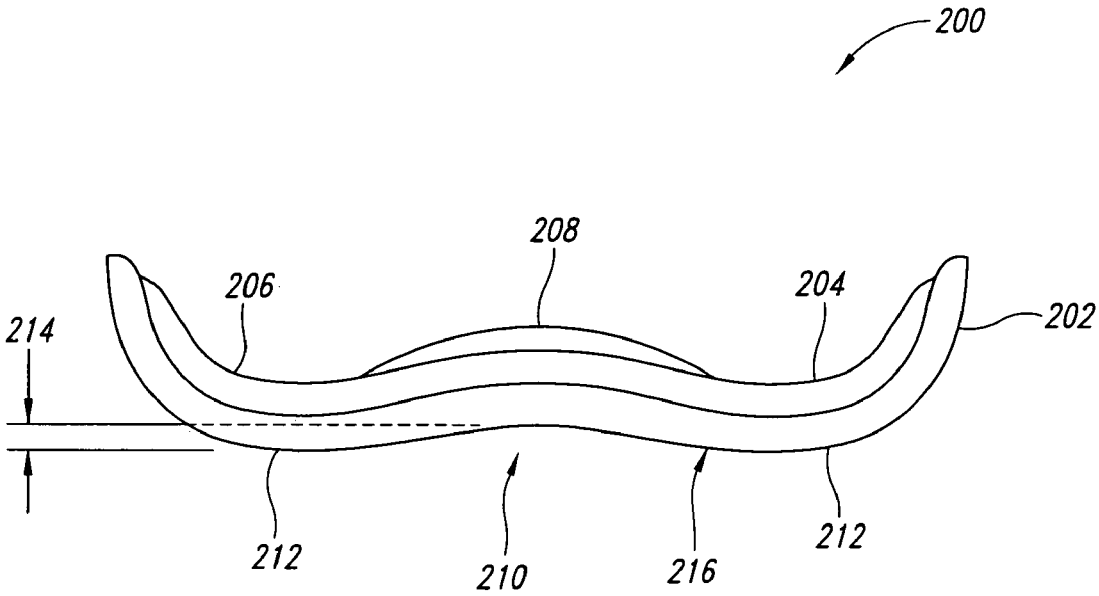
FIG. 13 is a cross-sectional view through the arch region of the shoe of FIG. 1.

FIG. 13 shows a dynamic arch system 200 according to another illustrated embodiment where the configuration of an orthotic chassis 202 in combination with an orthotic footbed 204 in the arch region automatically and continually adjusts and supports the arch region of the anatomical foot. The orthotic footbed includes a first material 206 and a second material 208, which may be either the same material with different densities or two different materials. The orthotic chassis 202 is configured with a central arch region 210 disposed between two side arch regions 212. The central arch region 210 is offset above the two side arch regions 212 by a distance 214, where the distance 214 is in the range of about 1.0 to 8.0 mm as measured from a lower surface 216 of the orthotic chassis 202.

In operation, the second material 208 of the orthotic footbed 204 is self-adjusting depending on the amount of force (e.g., weight) applied in the arch region of the shoe. As discussed earlier, the second material 208 can be made from a softer, less firm material such as TPU, EVA, or EPQ. The jelly-like quality of EPQ, for example, permits the second material 208 to supportively conform to the arch region of an anatomical foot. In addition, the stiffness of the first material 206 in combination with the stiffness of the orthotic chassis 202 operates as a resilient beam that automatically and dynamically flexes up and down as the applied force in the shoe changes. Once the applied force to the arch region of the shoe is substantially removed, the first material 206 and orthotic chassis 202 deflect back to a substantially unloaded position while the second material uncompresses and moves also moves back to a substantially unloaded configuration.

Figure 14A:
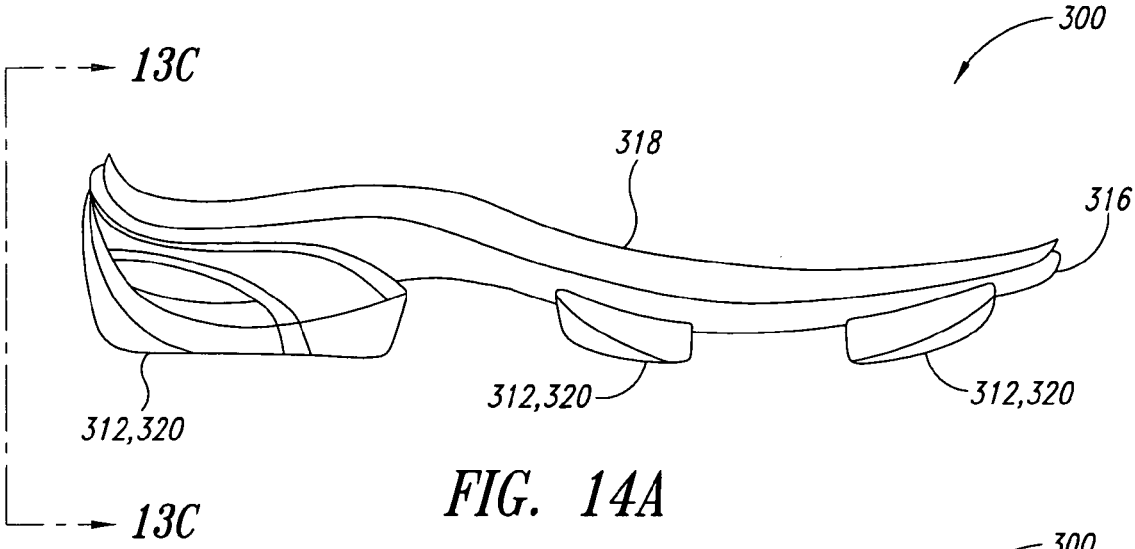
FIG. 14A is a side, elevational view of a shoe having a plurality of selective pods comprising a sole according to one illustrated embodiment.
Figure 14B:
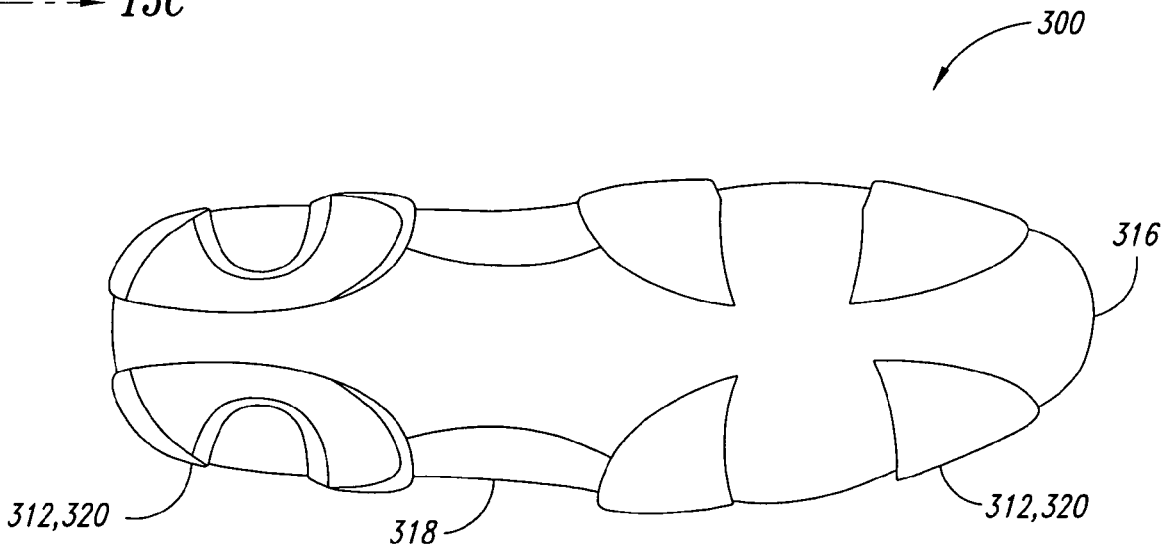
FIG. 14B is a bottom plan view of the shoe of FIG. 14A.
Figure 14C:
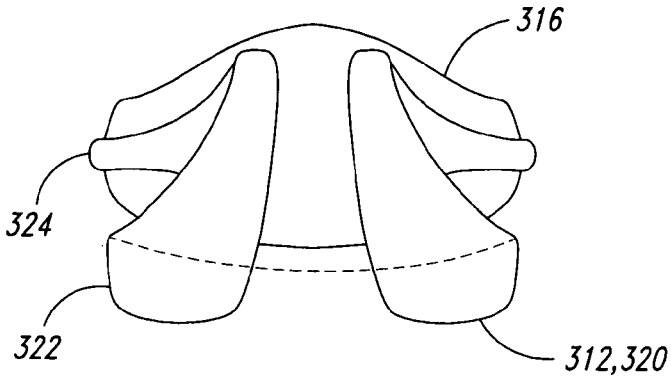
FIG. 14C is a rear elevational view of the shoe of FIG. 14A.
Figure 15A:
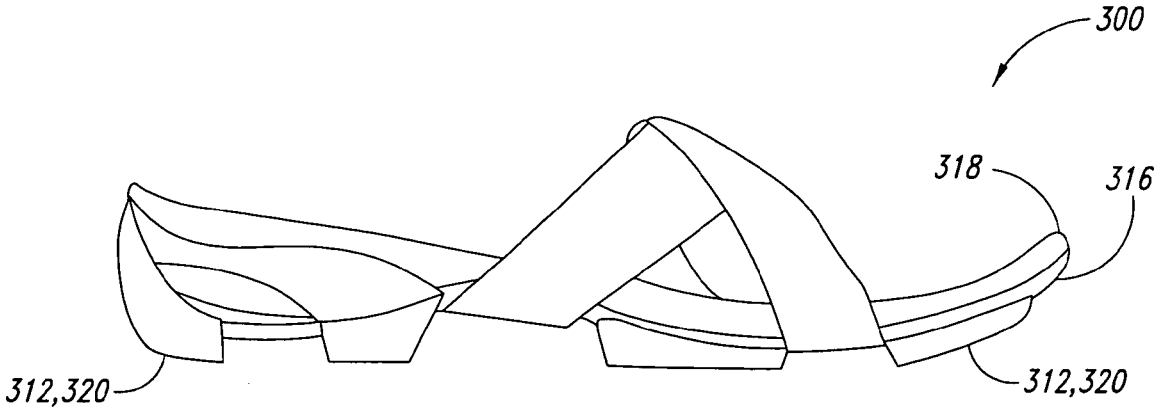
FIG. 15A a side, elevational view of a shoe with one type of shoe upper and having a plurality of selective pods comprising a sole according to another illustrated embodiment.
Figure 15B:
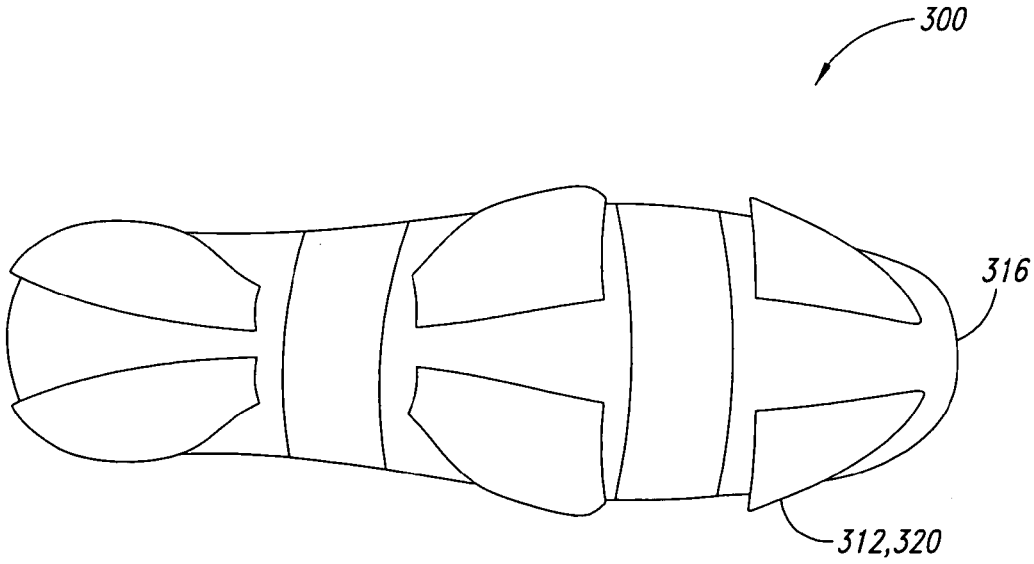
FIG. 15B is a bottom plan view of the shoe of FIG. 15A.
Figure 16A:
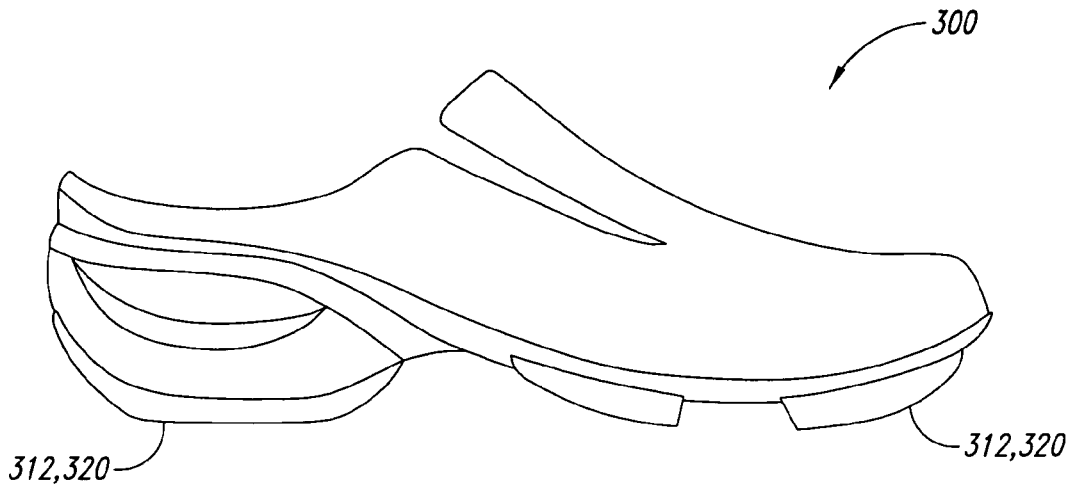
FIG. 16A a side, elevational view of a shoe with another type of shoe upper and having a plurality of selective pods comprising a sole according to yet another illustrated embodiment.
Figure 16B:
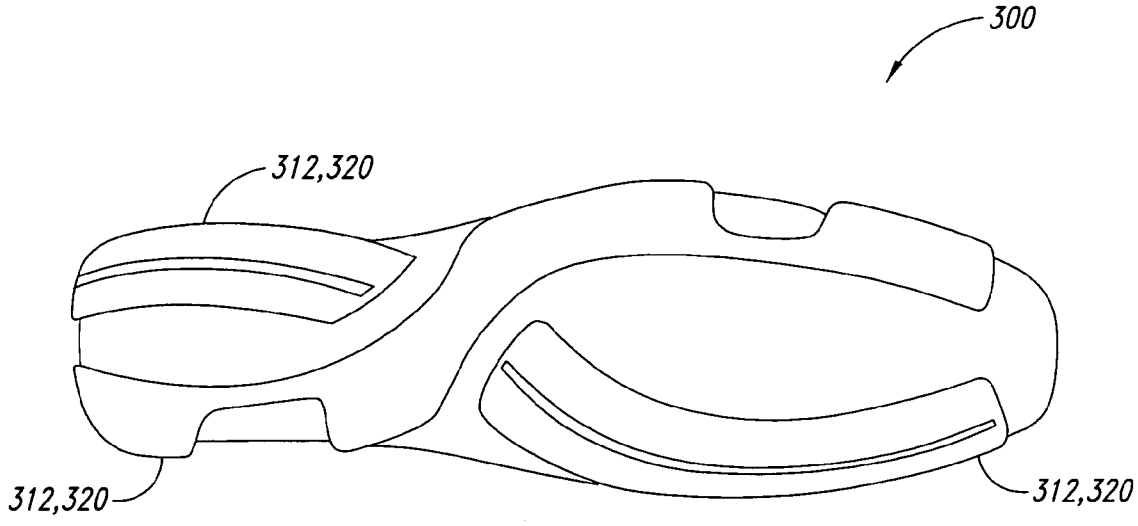
FIG. 16B is a bottom plan view of the shoe of FIG. 16A.
Figure 17A:
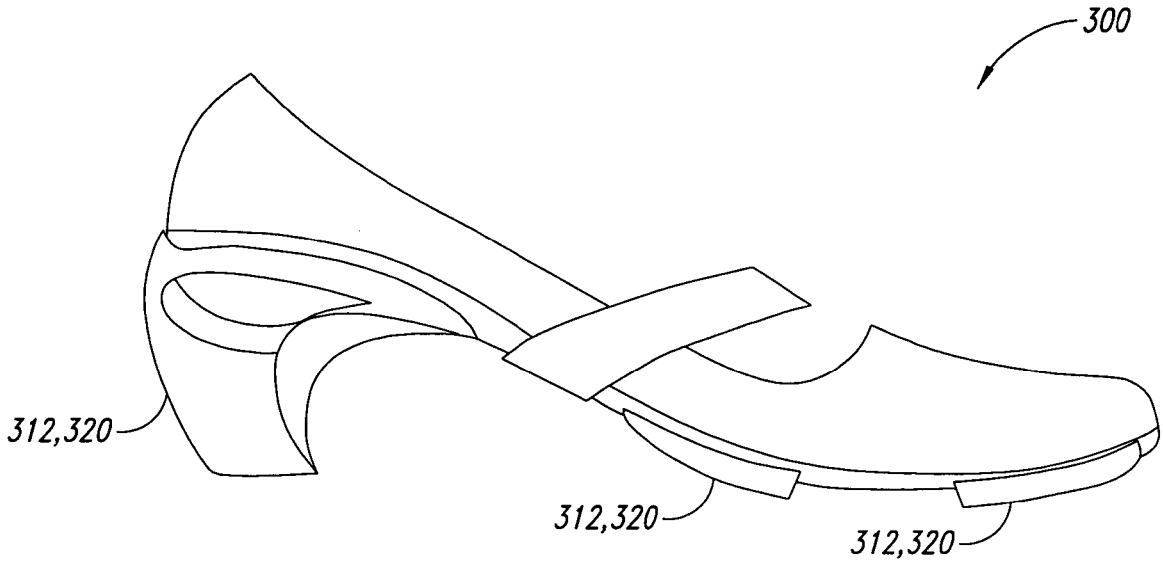
FIG. 17A a side, elevational view of a shoe with another type of shoe upper and having a plurality of selective pods comprising a sole according to still yet another illustrated embodiment.
Figure 17B:
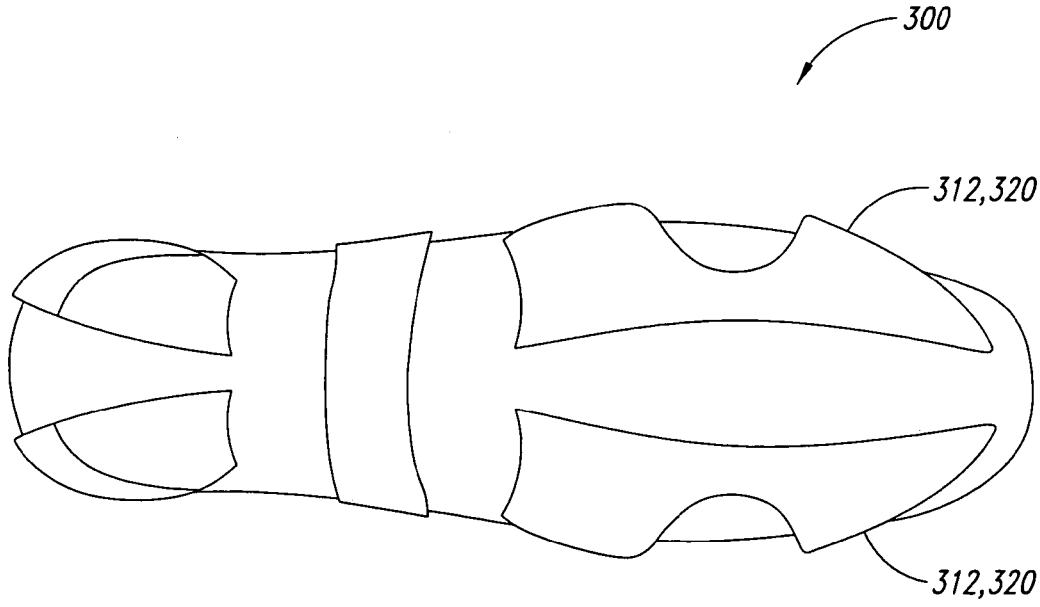
FIG. 17B is a bottom plan view of the shoe of FIG. 17A.

FIGS. 14A through 17B show a variety of configurations of a shoe 300 having an upper 310, a sole 312, an orthotic chassis 316, and an orthotic footbed 318 according to the illustrated embodiments. FIGS. 14A-14C show a plurality of pods 320 that form the sole 312. The pods are arranged on the front portion and the heel portion of the shoe 300. As shown in FIG. 14C, the heel pod 320 is configured with a vertical member 322 to vertically support the heel cup of the orthotic chassis 316 and a lateral member to provide lateral stability to the shoe 300.

FIGS. 15A through 17B show other designs of the sole 312 where the pods 320 are arranged in a variety of ways. These exemplary embodiments are provided to show that the pods 320 of the sole 312 can be arranged in any number of ways. The embodiments illustrated in FIGS. 15A-17B each include an orthotic chassis with an associated orthotic footbed suspended on a plurality of pods, despite variations in heel height, shoe shape, and style. Accordingly, the exemplary embodiments of FIGS. 14A-17B are merely examples and are not meant to limit or narrow the scope of the invention.

Method of Making a Suspended Orthotic Shoe

Figure 18:
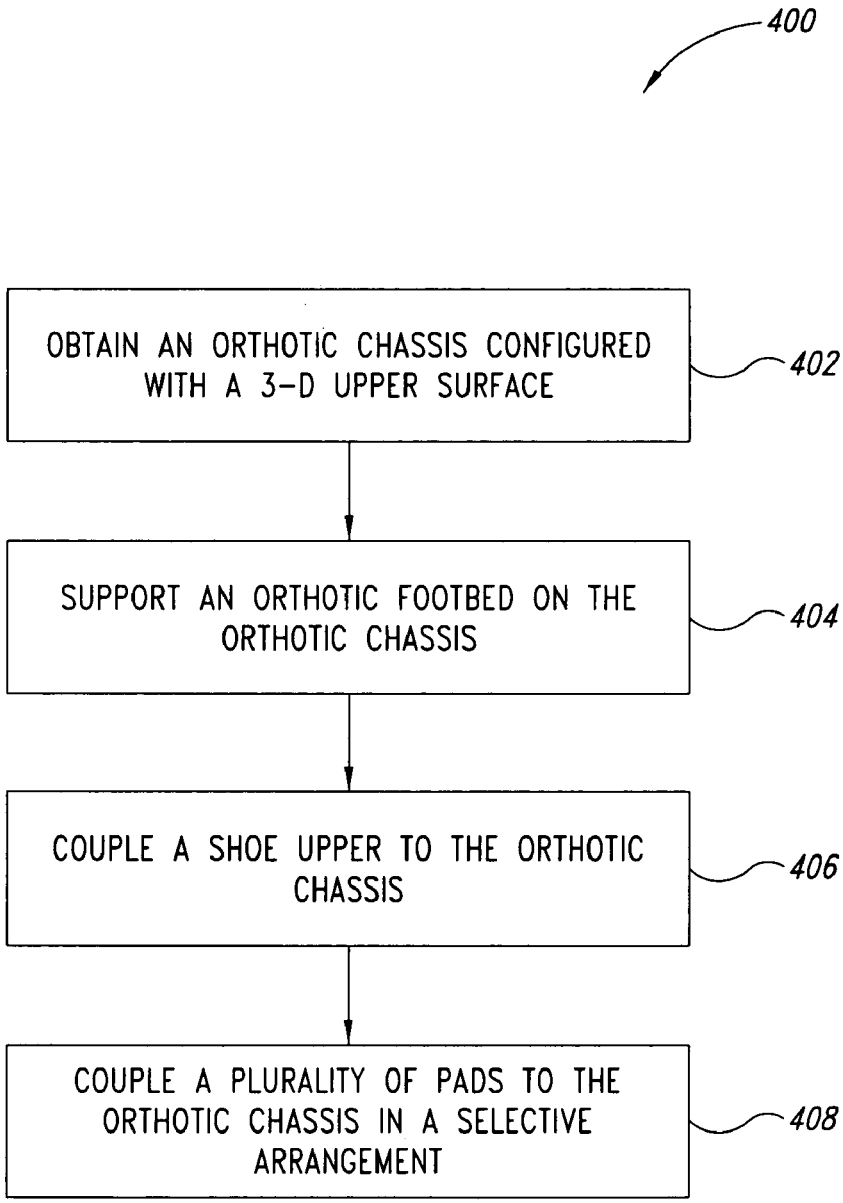
FIG. 18 is a flowchart describing a method of manufacturing a shoe according to one embodiment.

FIG. 18 shows a method 400 for making a shoe according to at least one embodiment described herein. More particularly, an orthotic chassis that includes a three-dimensional upper surface is obtained at step 402. An orthotic footbed is supported on the orthotic chassis at step 404. The orthotic footbed includes a first surface contoured to complementarily conform and be in close contact with the upper surface of the orthotic chassis. A shoe upper is coupled to at least a portion of the orthotic chassis and/or the orthotic footbed at step 406. The shoe upper can be stitched, bonded, or coupled to the orthotic chassis and/or the orthotic footbed by any available manner. The number of pods comprising the sole are coupled to the orthotic chassis in a selective arrangement at step 408. In one embodiment, the pods are bonded to the orthotic chassis. Each pod is spaced apart by a distance from an adjacent pod and an intermediate region of the orthotic chassis spans the distance between the respective pods to support the orthotic chassis and the associated orthotic footbed.

In conclusion, the shoe 10, as described herein, is designed from the beginning of the shoe building process with the components necessary to form a fully integrated and functional orthotic system. The unique concept of the suspended orthotic shoe provides the wearer with a shoe that is both stylish and comfortable.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of shoes, shoe assemblies and/or orthotic devices that operate in accordance with the claims. Accordingly, the invention is not limited by the disclosure, but instead its scope is to be determined entirely by the following claims.

What is claimed is:

1. A shoe comprising to better define over the prior art of record:

an orthotic footbed moldably configured with a three-dimensional, anatomically-shaped contour, the footbed having heel and toe portions extending from a metatarsal region, the heel portion having a first structural stiffness, the toe portion having a second structural stiffness different from the structural stiffness, and the metatarsal region having a structural stiffness sufficient to substantially maintain at least a vertical deformation of the toe portion relative to the heel portion after being loaded and unloaded;

a chassis, moldably configured in conjunction with the orthotic footbed to nestingly and similarly conform therewith; and a shoe sole comprising a plurality of pods, each pod extending generally in a fore-aft direction and coupled to the chassis, wherein a first region of the chassis spans a first lateral distance between a forward pair of pods and a second region of the chassis spans a second lateral distance between a rearward pair of pods, the forward and rearward pairs of pods separated by an arch region of the chassis, wherein the footbed and chassis structurally and closely cooperate to selectively distribute weight to the plurality of pods while the footbed remains removable from the chassis.

2. The shoe of claim 1 wherein the footbed includes a single material having different densities to the different structural stiffness.

3. The shoe of claim 1 wherein at least a portion of the metatarsal region supports a plantar fascia ligament region of the anatomical foot.

4. The shoe of claim 1 wherein the first structural stiffness is more firm than the second structural stiffness.

5. The shoe of claim 1 wherein the heel region of the footbed is more firm than the metatarsal region.

6. The shoe of claim 1 wherein the footbed being removable from the chassis includes the footbed and chassis remaining separatable.

7. The shoe of claim 1 wherein the shoe is a casual dress shoe.

8. The shoe of claim 1 wherein the chassis includes a molded, integrated heel cup.

9. A shoe comprising:

a shoe upper; and a shoe sole having an orthotic footbed removably positionable on a chassis fixed to a plurality of pods, a three-dimensional, anatomically-shaped contour, the footbed having heel and toe portions extending from a metatarsal region, the heel portion having a first structural stiffness, the toe portion having a second structural stiffness different from the first structural stiffness, and the metatarsal region having a structural stiffness sufficient to substantially maintain at least a vertical deformation of the toe portion relative to the heel portion after being loaded and unloaded; and a the chassis, moldably configured in conjunction with the orthotic footbed to nestingly and similarly conform therewith;

a shoe so the plurality of pods including a forward pair of pods and a rearward pair of pods, the forward and rearward pairs of pods separated by an arch region of the chassis, wherein the forward pair of pods are located forward of the arch region and the rearward pair of pods are located aft of the arch region, wherein the footbed and chassis structurally and closely cooperate to distribute weight to the plurality of pods.

10. The shoe of claim 9 wherein, the chassis moldably configured in conjunction with the orthotic footbed to nestingly and similarly conform therewith includes the chassis and orthotic bed have a substantially similar periphery.

11. The shoe of claim 9 wherein the shoe is a casual dress shoe.

12. The shoe of claim 9 wherein the chassis includes a molded heel cup.

13. A method for making a shoe, the method comprising:

forming a footbed with a first density portion and a second density portion, at least the first density portion complementary shaped to conform to selected portions of an anatomical food molding an orthotic footbed to have a three-dimensional, anatomically-shaped contour, the footbed formed with heel and toe portions extending from a metatarsal region, the heel portion having a first structural stiffness, the toe portion having a second structural stiffness different from the first structural stiffness, and the metatarsal region having a structural stiffness sufficient to substantially maintain at least a vertical deformation of the toe portion relative to the heel portion after being loaded and unloaded;

molding a chassis, in conjunction with the orthotic footbed to nestingly and similarly conform therewith;

removably supporting the orthotic footbed on the molded chassis;

coupling a forward pair of pods to the chassis;

coupling a rearward pair of pods to the chassis, the rearward pair of pods separated from the forward pair of pods by an arch region of the shoe; and attaching a shoe upper to the shoe.

14. The method of claim 13 wherein molding the chassis includes configuring a periphery of the chassis to substantially conform with a periphery of the orthotic footbed.

15. The method of claim 13 wherein coupling the pods to the chassis includes bonding the pods to the chassis.

16. A shoe comprising:

an a molded orthotic footbed configured to conform to selected portions of an anatomical foot;

a molded chassis having a contour configured to structurally correspond with the orthotic footbed and nestingly and similarly conform therewith;

a shoe sole coupled to the chassis, the shoe sole having a forward pair of pods separated from a rearward pair of pods by an arch portion of the chassis; and a plurality of recesses molded with the chassis, recess each configured to receive one of the pods with a lip portion extending at least partially around a periphery of at least one of the forward pair of pods, wherein the extended height of the lip portion is limited to prevent ground contact therewith when the pods are weighted.

* * * * *